US006927182B2

(12) United States Patent
Rock et al.

(10) Patent No.: US 6,927,182 B2
(45) Date of Patent: Aug. 9, 2005

(54) ENHANCED COMPOSITE SWEATSHIRT FABRIC WITH KNIT CONSTRUCTED CHANNELS

(75) Inventors: Moshe Rock, Brookline, MA (US); Charles Haryslak, Haverhill, MA (US)

(73) Assignee: Malden Mills Industries, Inc., Lawrence, MA (US)

( * ) Notice: Subject to any disclaimer, the term of this patent is extended or adjusted under 35 U.S.C. 154(b) by 262 days.

(21) Appl. No.: 10/047,939

(22) Filed: Oct. 23, 2001

(65) Prior Publication Data

US 2003/0077967 A1 Apr. 24, 2003

(51) Int. Cl.[7] ..... D05C 11/00; D05C 17/00; B32B 33/00

(52) U.S. Cl. ..... 442/312; 442/318; 428/88; 428/89; 428/91; 428/92; 66/22

(58) Field of Search ..... 442/85, 318, 312, 442/304; 428/88, 89, 91, 92; 4/85

(56) References Cited

U.S. PATENT DOCUMENTS

| | | | | |
|---|---|---|---|---|
| 2,269,088 A | | 1/1942 | Hanisch et al. | |
| 4,733,546 A | | 3/1988 | Toda | |
| 5,119,644 A | | 6/1992 | Strauss et al. | |
| 5,149,583 A | | 9/1992 | Saarikettu | |
| 5,312,667 A | | 5/1994 | Lumb et al. | |
| 5,547,733 A | | 8/1996 | Rock et al. | |
| 5,636,533 A | * | 6/1997 | Hunneke et al. | 66/196 |
| 5,817,391 A | * | 10/1998 | Rock et al. | 428/86 |
| 5,906,876 A | | 5/1999 | Conway | |

FOREIGN PATENT DOCUMENTS

EP 1 067 226 A2 1/2001

* cited by examiner

*Primary Examiner*—Ula Ruddock
*Assistant Examiner*—Jennifer Boyd
(74) *Attorney, Agent, or Firm*—Fish & Richardson P.C.

(57) ABSTRACT

A composite textile fabric for rapidly moving moisture away from the skin is provided. The composite fabric includes an inner fabric layer (the technical back) formed therealong with a plurality of vertical and horizontal channels and made of a yarn comprising a plurality of fibers of polyester or nylon which have been rendered hydrophilic. The fabric also includes an outer fabric layer (the technical face) made of a moisture absorbent material, a yarn comprising a plurality of fibers primarily of polyester of other man-made yarn which has also been rendered hydrophilic, or a combination thereof. The inner fabric layer and the outer fabric layer are formed concurrently by knitting a plaited construction so that the layers are distinct and separate, yet integrated one with the other.

14 Claims, 1 Drawing Sheet

ENHANCED COMPOSITE SWEATSHIRT FABRIC WITH KNIT CONSTRUCTED CHANNELS

BACKGROUND OF THE INVENTION

This invention relates to a composite raised surface textile fabric, and more particularly, to a composite raised surface textile fabric which maintains comfortable temperature conditions along the skin and which acts to move liquid moisture away from the skin by evaporation and through a garment made with the composite fabric.

Most polyester textile fabrics are likely to result in the substantial entrapment of liquid moisture between the wearer's skin and undergarments, or between the undergarments of the wearer and the outerwear. When moisture saturation takes place, the excess moisture wets the body of the garment wearer, and the wearer begins to feel rather uncomfortable.

Although it is possible to use a composite textile fabric with a first layer made of either a polyester or nylon material and a second layer having a substantial portion of a moisture-absorbent material such as cotton, as, by way of example, illustrated in U.S. Pat. No. 5,312,667 owned by Maiden Mills Industries, such a composite textile fabric can be improved. Because the second layer includes a substantial portion of a moisture-absorbent material, even though the "micro-climate" between the wearer's skin and the inner fabric layer is drier and the likelihood of a back-up of liquid moisture from the outer fabric layer to the inner fabric layer is reduced, moisture evaporation from the outside layer is less than desired. The moisture absorbent material becomes saturated, and since there is little driving force to spread the moisture outwardly, evaporation is limited and the excess moisture backs up into the inner layer, wets the wearer and leads to discomfort.

U.S. Pat. No. 5,547,733 owned by Malden Mills describes a composite textile fabric with first and second layers made from polyester fibers which have been rendered hydrophillic. This fabric construction exhibits improved transport of moisture through the first layer into the second layer where it spreads for evaporation; however, this construction is less than desirable since it provides warmth during inactivity (which is desirable) and during activity (which is undesirable). During inactivity, the fabric completely abuts against the skin of the wearer, minimizing the amount of warmth provided to the wearer. During activity, air flow between the fabric and the wearer's skin is insufficient to provide a reasonable cooling effect.

Accordingly, it would be desirable to provide an improved textile fabric which overcomes the above disadvantages.

SUMMARY OF THE INVENTION

Generally speaking, in accordance with the invention, a composite textile fabric for rapidly moving liquid moisture away from the skin and evaporating that moisture from the surface of its outer surface is provided. The composite fabric includes an inner fabric layer (the technical back) formed with a plurality of vertical and horizontal channels and made of a yarn comprising a plurality of fibers of polyester, nylon or other synthetic fabric which have been rendered hydrophilic. Moisture is conducted along the hydrophilically rendered fibers of the inner layer and evaporated from the hydrophilically rendered and/or absorbent fibers of the outer layer. The channels of the inventive fleece provide for additional moisture evaporation during activity which has a desirable cooling effect. The fabric also includes an outer fabric layer (the technical face) made of a yarn of moisture absorbent material, a yarn comprising a plurality of fibers of polyester or other synthetic material which have also been rendered hydrophilic, or a combination thereof. The inner fabric layer and the outer fabric layer are formed concurrently by knitting a plaited construction so that the layers are distinct and separate, yet integrated with one another.

In application, the composite textile fabric of the invention is used in a variety of garments, including sweatshirts, sweatpants, underwear, bathrobes, and various types of exercise clothing. The inner fabric layer is worn against the skin or undergarment of the wearer. The channels of the inner layer promote warmth during inactivity and heat dissipation during physical activity. Moisture from the skin is quickly transported through the inner layer where it is carried to the outer fabric layer where it is absorbed or is spread for evaporation.

Of significance is the fact that the fabric construction is plaited. This feature makes it possible for capillary action to move liquid moisture from the wearer's skin through the inner fabric layer to the outer fabric layer and helps to create a substantial moisture concentration gradient between the inner fabric layer (which quickly transports water from the skin) and the outer fabric layer.

Accordingly, it is an object of the invention to provide an improved composite textile fabric for promoting warmth during physical inactivity and heat dissipation during physical activity.

It is another object of the invention to provide an improved composite textile fabric for enhancing the transport of liquid moisture away from the skin.

It is also an object of the invention to provide an improved composite textile fabric having a plurality of fibers for conducting liquid moisture.

A further object of the invention is to provide an improved composite textile fabric which has a plaited construction for promoting the moisture concentration gradient between the two layers.

Still other objects and advantages of the invention will in part be obvious, and will in part be apparent from the following description.

The invention accordingly comprises the several steps and the relation of one or more of the steps with respect to each of the others, and the material or materials having the features, properties and relation of constituents which are exemplified in the following detailed disclosure, and the scope of the invention will be indicated in the claims.

BRIEF DESCRIPTION OF DRAWINGS

For a fuller understanding of the invention, reference is made to the following description, taken in connection with the accompanying drawings, in which.

DETAILED DESCRIPTION OF THE PREFERRED EMBODIMENT

Figure 1:
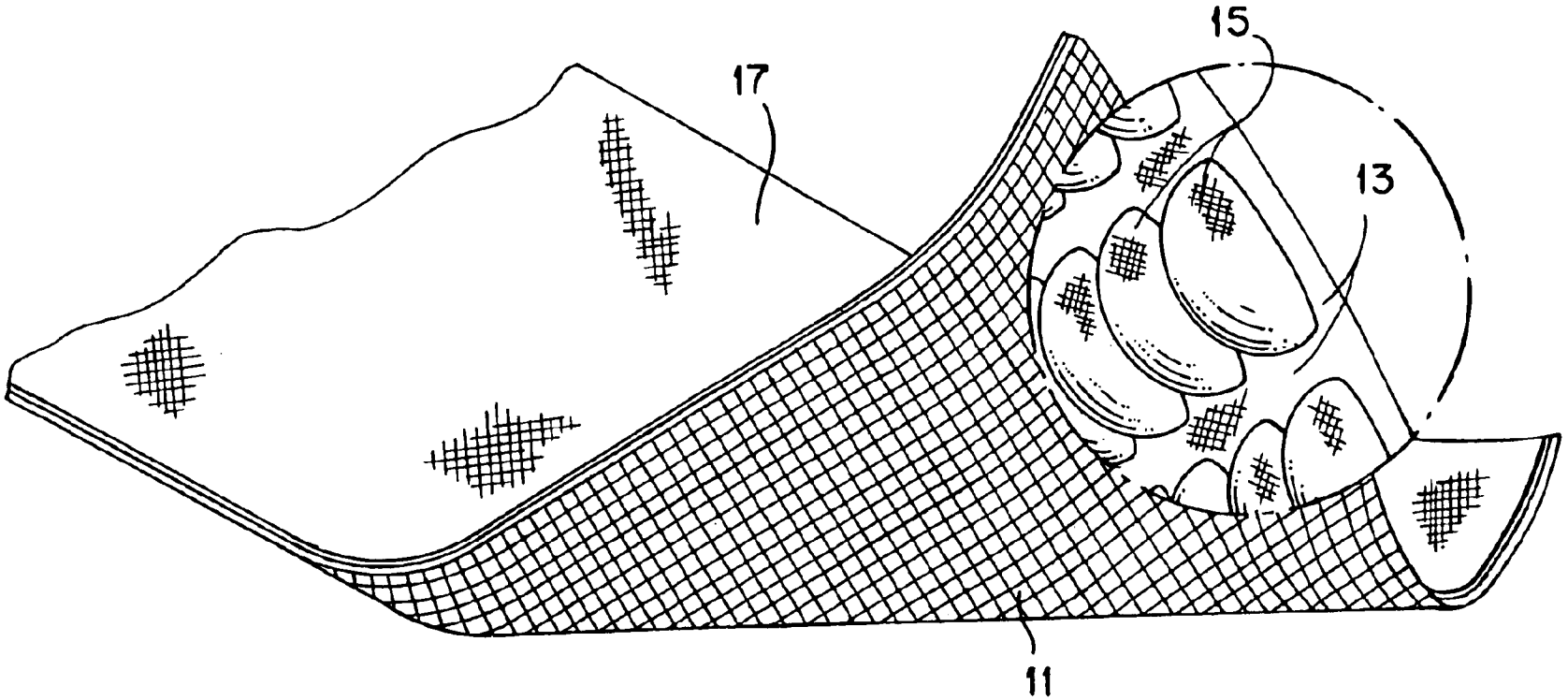
FIG. 1 is a perspective view depicting the composite textile fabric of the invention.

The composite textile fabric of the invention includes an inner fabric layer 11 formed therealong with a plurality of vertical and horizontal channels 13 between the fiber pillars 15 as illustrated in FIG. 1 and made of yarn comprising a plurality of synthetic fibers such as polyester or nylon which have been rendered hydrophilic. The fabric also includes an outer fabric layer 17 made from a moisture absorbent material, a plurality of fibers such as polyester or other synthetic material which have also been rendered hydrophilic, or a combination thereof. Both fabric layers are formed concurrently by knitting a plaited construction so that the layers are distinct and separate, yet integrated one with the other.

The plurality of channels formed along the inner fabric layer facilitates maintaining a cushion of air along the skin for added warmth during static physical conditions and enhanced air flow during physical activity, thereby creating a heat dissipating or cooling effect.

Vertical channels formed along the inner fabric layer are constructed with the use of tipped and tipless sinkers, high and low sinkers, or some combination of both (e.g., 4 tipped sinkers, 2 tipless, 3 tipped sinkers, 2 tipless, repeat; 3 high sinkers, 1 low sinker, 2 high sinkers, 2 low sinkers, repeat; etc.). Horizontal channels may be created by removing the loop yarn from one or more feeds in some arrangement, or with the use of a shrinkable loop yarn which would create a channel after processing with wet (e.g., hot water, steam) or dry (air) heat (e.g., 4 loop in, 2 loop out, 3 loop in, 2 loop out, repeat; 3 low shrinkage loop, 3 high shrinkage loop, 3 low shrinkage loop, 3 high shrinkage loop, repeat; etc.). Different levels of thermal insulation may be created by reducing or increasing the sinker height, by napping/brushing the loops, or by leaving them unnapped/unbrushed. As sinker height is increased, the fiber pillar height is increased and the insulation factor of the fabric is increased, also.

The inventive construction reduces the high rate of increase in vapor pressure that is common in 100% synthetic constructions and, in turn, minimizes discomfort in early dynamic states until equilibrium is reached, since the channels provide an avenue for the evaporation of moisture from the skin not available in fabrics that have intimate skin contact throughout. Furthermore, by maintaining the moisture absorbent fibers away from the skin, the after chill effect that commonly occurs in 100% hydrophilic constructions when going from a highly active state (dynamic) to a state of rest (static) is reduced significantly.

The inner fabric layer comprises between about 30 and 70 percent by weight of the fabric. The outer fabric layer comprises between about 70 and 30 percent by weight of the fabric. The amount of each fabric layer is selected based on the desired weight of the composite fabric, the desired end use of the composite fabric, and the specific requirements for transferring moisture from the inner fabric layer to the outer fabric layer. The weight per unit area of the composite fabric is between about 3 ounces/yard$^2$ and 15 ounces/yard$^2$, depending upon the use requirements for thermal protection and moisture control.

The construction of the composite fabric, as set forth above, is such that it has a plaited construction—although each fabric layer is distinct and separate, each is integrated with the other. As a result, the composite fabric functions as a single unit.

The composite fabric is constructed as a knit, two-end fleece, three-end fleece, terry with regular plaiting, double terry, and tricot.

The outer fabric layer may include a moisture absorbent material, as discussed above. The preferred moisture absorbent material is cotton. Other suitable moisture absorbent materials include rayon and wool.

The outer fabric layer may include a plurality of polyester or other synthetic fibers which have been rendered hydrophilic. In this construction, the denier of the yarn fibers of the inner fabric layer and the outer fabric layer are in a ratio of between 1:20 and 10:1; while the denier of the yarn (itself) of the two layers is in a ratio of between 1:6 and 1:1.5. More specifically, the yarn fibers of the inner fabric layer are in a size range of between 0.15 dpf and 3.0 dpf, and the yarn fibers of the outer fabric layer are within a size range of between about 0.3 dpf and 3.0 dpf. The denier of the yarn (itself) of the outer fabric layer is in a range of between about 50 denier and 300 denier, while the denier of the yarn of the inner fabric layer is in a range of between 50 denier and 200 denier.

Preferably, the surface of the inner fabric layer is sanded, brushed or napped in order to raise the fabric surface so that the garment is soft to the skin and moisture conduction is enhanced. The surface of the outer fabric is not raised.

In order to render the inner and outer layers hydrophilic, as desired, a material such as a low molecular weight polyester may be added to the dye bath that is used to dye each of the layers. Reference is made to U.S. Pat. No. 5,312,667 which is hereby incorporated by reference for its teaching and description of various types of low molecular weight polyesters that are suitable for the inventive composite textile fabric.

By chemically treating the inner fabric layer, it is rendered substantially hydrophilic. As a result, the transfer of perspiration from the surface of the inner fabric layer to the outer fabric layer is enhanced—liquid moisture is made transportable along the surface fiber by capillary action. Moisture that has been conducted to the outer fabric layer, if fibers in the outer layer have also been rendered hydrophilic, spreads along the surface of the layer, is rapidly evaporated (it is not absorbed), and therefore, the outer fabric layer will rapidly dry.

The outer fabric layer may be a combination of a moisture absorbent material such as cotton, rayon or wool and a polyester and a synthetic yarn that has been rendered hydrophilic. For example, the cotton blended with the polyester can accommodate the extra moisture generated by the wearer, for example, during physical exertion, and the moisture level in the "micro-climate" between the wearer's skin and the inner fabric layer can be kept at a dry and comfortable level, further increasing the comfort level of the wearer.

A significant aspect of the inventive composite fabric is that there is nothing interposed between the two fabric layers. These layers are formed concurrently by knitting a plaited construction so that the layers are distinct and separate yet integrated one to the other. Together, the layers act to move moisture away from the skin and through a garment made with the composite fabric by capillary action, enhanced by the creation of a moisture concentration gradient. Evaporation into the exposed air from the surface of the outer layer sets up the gradient and in part serves as the driving force to move or transport the moisture through the fabric.

It will thus been seen that the objects set forth above, and those made apparent from the preceding description, are efficiently attained, and since certain changes may be made in the products set forth above without departing from the spirit and scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A composite textile fabric formed by concurrently knitting a plaited construction comprising an inner fabric layer and an outer fabric layer, the inner fabric layer and the outer fabric layer each being distinct and separate but intimately plaited together in an unitary body, the inner fabric being formed of yarn comprising synthetic yarn fibers rendered hydrophilic and defining a surface configured to be worn facing a wearer's skin, and the outer fabric layer being formed of a material selected from the group consisting of: a moisture absorbent material, a plurality of synthetic yarn fibers, and a combination thereof, and defining a surface to be worn as an outer surface of a garment, the outer fabric layer being disposed immediately adjacent to, and in intimate contact with, the inner fabric layer, for movement of moisture between the inner fabric layer and the outer fabric layer, the surface of the inner fabric layer comprising discrete pillar regions of relatively deeper pile, said discrete pillar regions of relatively deeper pile being spaced apart and isolated from each other by regions of relatively shorter pile or no pile that form a plurality of intersecting channels passing among said discrete pillar regions and open to the wearer's skin, said plurality of intersecting channels defining insulation regions to contain a cushion of air for promoting warmth under static conditions during periods of wearer inactivity and defining circulation regions creating avenues for flow of air and enhanced evaporation of moisture from the skin of the wearer for creating a heat dissipation or cooling effect during periods of physical activity by the wearer.

2. The fabric of claim 1, wherein said discrete pillar regions of said inner fabric layer have raised surfaces and said outer fabric layer has a non-raised surface.

3. The fabric of claim 1, wherein said moisture absorbent material is selected from the group consisting of: cotton, rayon and wool.

4. The fabric of claim 1, wherein said fabric has a construction selected from the group consisting of: knit, two-end fleece, three-end fleece, terry with regular plaiting, double terry, and tricot.

5. The fabric of claim 1, wherein said inner fabric layer comprises between about 30 and 70 percent by weight of the fabric and said outer fabric layer comprises between about 70 and 30 percent by weight of the fabric.

6. The fabric of claim 1, wherein the synthetic fibers of said inner fabric layer are selected from the group consisting of: polyester and nylon.

7. The fabric of claim 1, wherein said outer fabric layer is made of yarn comprising a plurality of synthetic fibers.

8. The fabric of claim 7, wherein the denier of the yarn fibers of said inner fabric layer and said outer fabric layer are in a ratio of between about 1:20 and 10:1.

9. The fabric of claim 7, wherein the denier ratio of the yarn of said inner fabric layer to that of said outer fabric layer is between about 1:6 and 1:1.5.

10. The fabric of claim 7, wherein the yarn fibers of said inner fabric layer are in a size range of between about 0.15 and 3.0 dpf and the yarn fibers of said outer fabric layer are in a size range of between about 0.3 and 3.0 dpf.

11. The fabric of claim 7, wherein the yarn of said outer fabric layer is in a size range of between about 50 and 300 denier and the yarn of said inner fabric layer is in a size range of about 50 to 200 denier.

12. The composite textile fabric of claim 1, wherein said plurality of intersecting channels includes horizontal channels formed by selectively removing loop yarn from one or more feeds during knitting to create said horizontal channels with relatively shorter pile or no pile passing among said discrete pillar regions of relatively deeper pile.

13. The composite textile fabric of claim 1, wherein said plurality of intersecting channels includes horizontal channels formed by selectively using shrinkable loop yarn in one or more feeds during knitting to create, after processing with wet or dry heat, said horizontal channels with relatively shorter pile or no pile passing among said discrete pillar regions of relatively deeper pile.

14. The composite textile fabric of claim 1, claim 12, or claim 13, wherein said plurality of intersecting channels includes vertical channels formed by selectively alternating regions of tipped sinkers with regions of tipless sinkers, regions of high sinkers with regions of low sinkers, and/or regions of combinations of tipped sinkers and high sinkers with regions of combinations of tipless sinkers and low sinkers during knitting to create said vertical channels with relatively shorter pile or no pile passing among said discrete pillar regions of relatively deeper pile.

* * * * *

UNITED STATES PATENT AND TRADEMARK OFFICE

CERTIFICATE OF CORRECTION

PATENT NO. : 6,927,182 B2
DATED : August 9, 2005
INVENTOR(S) : Moshe Rock

It is certified that error appears in the above-identified patent and that said Letters Patent is hereby corrected as shown below:

Column 5,
Line 7, between "fabric" and "being" insert -- layer --.
Line 18, after "layer" delete ",".

Signed and Sealed this

Twenty-fifth Day of April, 2006

JON W. DUDAS
*Director of the United States Patent and Trademark Office*